United States Patent [19]

Holden

[11] 4,018,002

[45] Apr. 19, 1977

[54] TOY SIMULATING A WALKING ANIMAL

[75] Inventor: John Holden, Mount Joy, Pa.

[73] Assignee: Hasbro Development Corporation, Pawtucket, R.I.

[22] Filed: Jan. 2, 1976

[21] Appl. No.: 644,247

Related U.S. Application Data

[63] Continuation of Ser. No. 518,621, Oct. 29, 1974, abandoned.

[52] U.S. Cl. ..... 46/105; 46/110

[51] Int. Cl.[2] ..... A63H 13/02

[58] Field of Search ..... 46/102, 105, 110, 118, 46/206, 247

[56] References Cited

UNITED STATES PATENTS

| | | | |
|---|---|---|---|
| 2,180,623 | 11/1939 | Allen | 46/105 |
| 2,604,727 | 7/1952 | Swenson | 46/206 |
| 3,178,853 | 4/1965 | Greenwood et al. | 46/247 |

*Primary Examiner*—Louis G. Mancene
*Assistant Examiner*—Robert F. Cutting
*Attorney, Agent, or Firm*—Salter & Michaelson

[57] ABSTRACT

A toy simulating a walking animal that includes a body on which axles are mounted in spaced relation, wheels being mounted on the axles for rotation therewith. Levers simulating legs of an animal are secured to the wheels in offset eccentric relation and are reciprocably movable upon rotation of the wheels. A spring assembly is interconnected to the front axle and is responsive to the withdrawal and release of a draw-string for producing rotation of the front axle and a corresponding propelling movement of the body. The legs as secured to the wheels are constructed and arranged for reciprocable movement upon rotation of the wheels and propelling movement of the body for imparting a simulated walking action of the toy animal.

8 Claims, 6 Drawing Figures

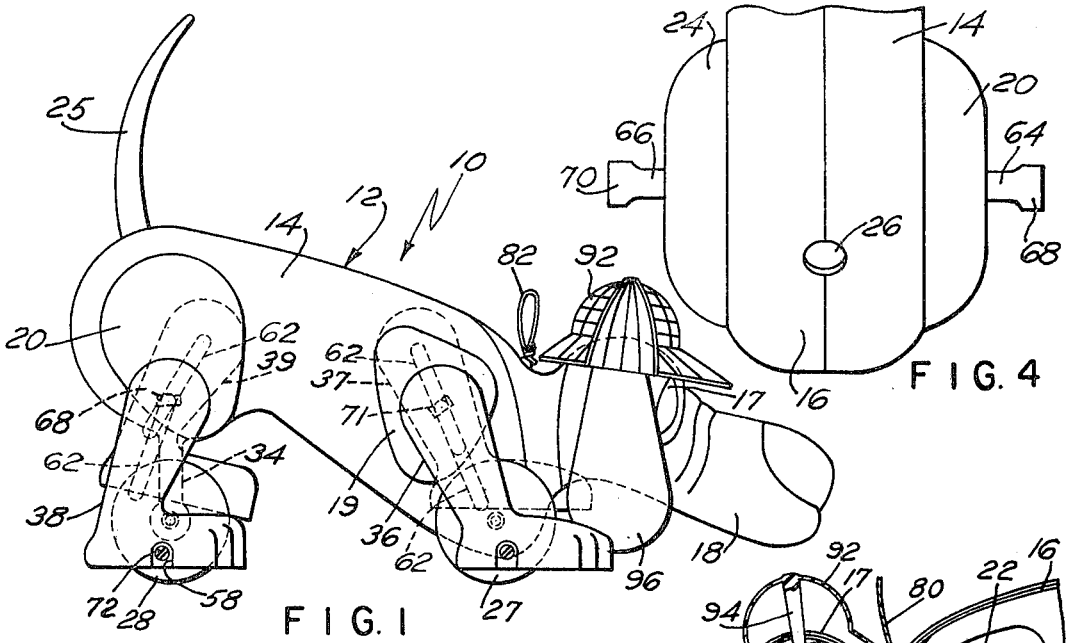
FIG. 1
FIG. 4
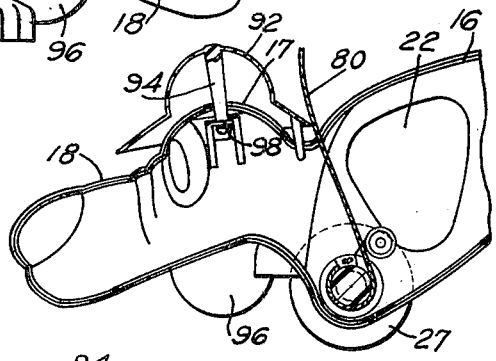
FIG. 3
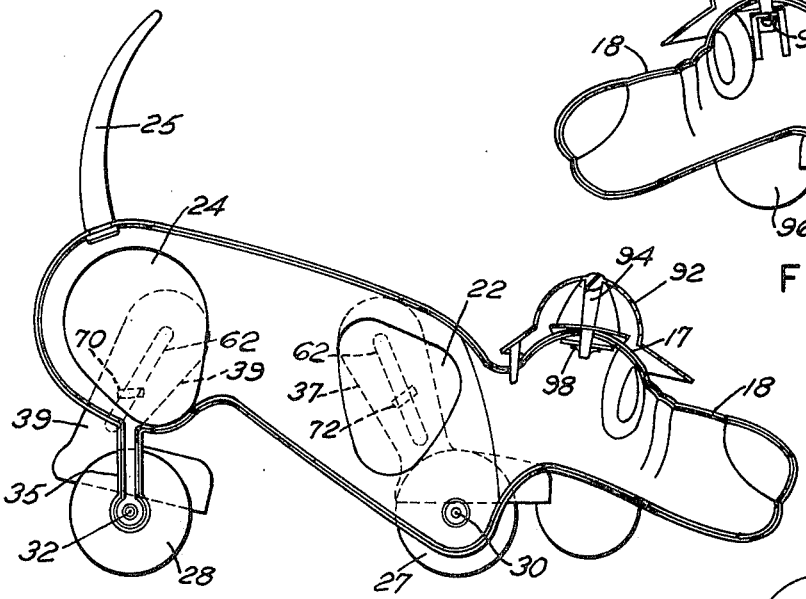
FIG. 2
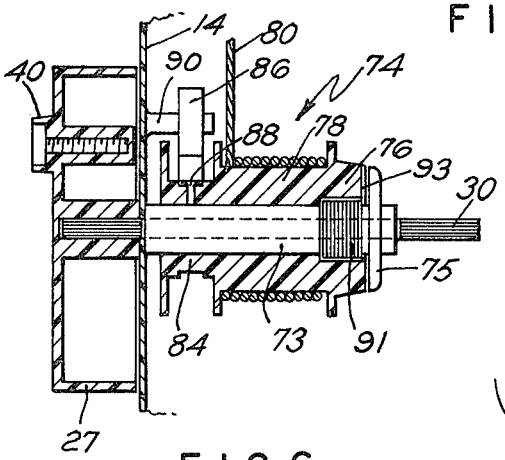
FIG. 6
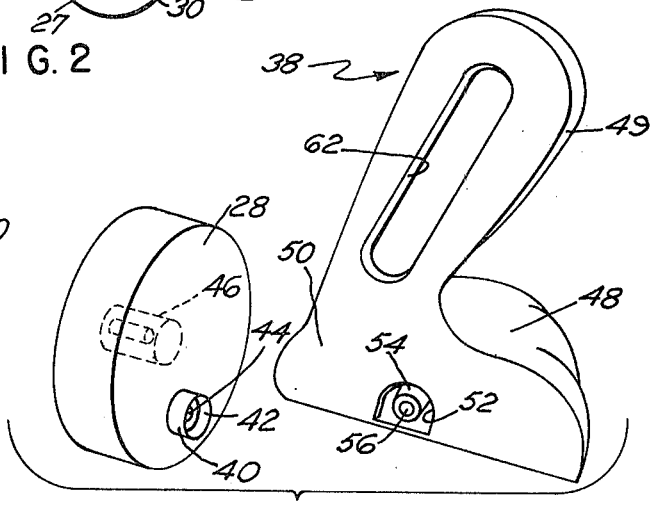
FIG. 5

TOY SIMULATING A WALKING ANIMAL

This a continuation, of application Ser. No. 518,621, filed Oct. 29, 1974. Now abandoned, for toy simulating a walking animal.

BACKGROUND OF THE INVENTION

The present invention relates to walking toys and in particular relates to a toy simulating the walking action of an animal.

Walking toys known heretofore have been primarily constructed with the view of producing movement thereof on wheels or the like for attracting the interest of a user of the toy, such as a child. Such prior known walking toys in some instances included some form of means for causing the toy to be propelled with or without a pulling or pushing motion by the user; and in such toys, spring wound devices were utilized. Normally, the interest of the child in the prior known walking toy was created by an unusual ornamental appearance of the toy or by utilizing audible devices that produced an interesting sound or melody as the toy was pulled or pushed by the child. Although such prior known walking toys as described have found some favor in the trade heretofore, they generally were not concerned with producing or simulating the walking action of an animal, which is the purpose of the present invention.

SUMMARY OF THE INVENTION

The present invention is directed to a toy that simulates the movement of a walking animal and for this purpose includes a body that is designed to represent a particular animal, such as a dog, cat, etc. Front and rear axles are mounted on the body in spaced relation and have wheels secured to the outer ends thereof for imparting a rolling movement of the toy in a more or less conventional fashion. In order to simulate the walking action of the animal simulated legs are secured to the wheels in a manner that the legs are caused to move in a generally reciprocating motion during rotation of the wheels;the legs being so arranged that they impart the impression of the actual motion of the animal as the wheels rotate upon a propelling movement of the toy. In order to produce the propelling movement of the toy on the wheels and to cause the legs to move in a walking action, a spring assembly is interconnected to the front axle of the toy and has a draw-string interconnected thereto that extends exteriorly of the toy body. Upon withdrawal of the draw-string from the toy body by the user, the spring is tensioned, and upon release of the draw-string, the spring is rapidly rewound to produce a rotation of the axle to which it is connected. Upon rotation of the axle to which the spring is connected, the toy is propelled in a forwardly direction; and as the wheels mounted on the toy body are rotated, the levers simulating the legs of the animal are reciprocated to simulate a walking action of the toy animal.

Accordingly, it is an object of the present invention to provide a toy that simulates the walking action of an animal upon a propelling movement of the toy over a surface.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention:

FIG. 1 is a side elevational view of the walking toy animal as embodied in the present invention;

FIG. 2 is a vertical sectional view of the walking toy animal as illustrated in FIG. 1;

FIG. 3 is a sectional view of the head and a portion of the body of the toy animal showing the spring assembly;

FIG. 4 is a top plan view of a rear portion of the body with the wheels and legs removed therefrom;

FIG. 5 is an exploded perspective view of a wheel and leg of the toy animal; and FIG. 6 is an elevational view of the negator spring assembly as mounted on the front axle and further showing in section one of the front wheels as mounted on the front axle.

DESCRIPTION OF THE INVENTION

Referring now to the drawing and particularly to FIGS. 1 through 4, a toy simulating a walking animal is illustrated and is generally indicated at 10. Although the walking toy animal as shown is representative of a bassett hound, it is understood tht various other animals may be depicted depending upon the requirements of use.

The toy animal 10 includes a body generally indicated at 12 that is molded of a plastic material in half sections indicated at 14 and 16 in FIG. 4. As will be described, the sections 14 and 16 are interfitted and when joined together define or simulate an animal such as the bassett hound, shown more particularly in FIG. 1. The sections 14 and 16 which define the body 12 form a head portion at the forward end thereof as indicated at 17, an elongated nose portion 18 being joined to the head portion. Formed on the sides of the section 14 are forward and rear enlargements 19 and 20, respectively; while enlargements 22 and 24 are formed on the section 16, the enlargements defining fixed portions of the legs of the toy animal. A tail 25 is fixed in an appropriate opening 26 (FIG.4) as formed between the sections 14 and 16 located at the top rear portion of the body 12.

In order to propel the toy animal 10 in a forwardly direction, wheels defined by front wheels 27 and rear wheels 28 are mounted on spaced axles 30 and 32, respectively. The axle 30 extends through appropriately formed openings located in the sections 14 and 16 adjacent to the head portion 17 of the toy animal, and project therebeyond for receiving the wheels 27 in friction-fitting relation thereon. The axle 32 also extends through openings as formed in downwardly extending abutting projections 34 and 35 located at the rear of the body 12 and on the underside of sections 14 and 16, respectively, the projections 34, 35 acting to elevate the rear portion of the body 12 to produce a more interesting effect and that is characteristic of a bassett hound in that it simulates a "sniffing" position. As shown in FIG. 2, the wheels 28 are mounted on the outermost ends of the axle 32 and are disposed directly below the enlargements 20 and 24 as formed on the rear portions of the sections 14 and 16, respectively.

In order to simulate a walking action of the toy animal, a plurality of levers are provided that define front legs 36 and 37, and rear legs 38 and 39, the legs 36, 37, 38 and 39 being constructed and mounted in such manner as to be movable in a reciprocating motion as the wheels 26 and 28 rotate. As will be described, the legs 36–39 are reciprocated in a generally vertical direction, and each leg as located on an axle is movable in opposite relation with respect to the other leg mounted on the same axle to further provide a realistic walking action for the toy animal.

Referring now to FIG. 5, one of the rear wheels 28 is illustrated together with the leg 38, and a description of the interrelation of wheel 28 and leg 38 will illustrate the manner in which all of the legs are secured to the wheels for movement in a reciprocating motion thereby. As shown in FIG. 5, wheel 28, which is molded of a plastic material in a one-piece construction, is formed with an outwardly extending eccentrically located projection 40 thereon that is formed with an interior recess 42 therein. A threaded opening 44 extends through an interior portion of the eccentric projection 40 and communicates with the recess 42 for receiving a screw, as will be described. The wheel 28 has a central interior hub 46 molded therein in which an opening is provided for receiving the end of the axle 32. Thus, the wheel 28 is mounted on the axle 32 by forcing the axle 32 into the opening as formed in the interior hub 46.

The leg 38 which is representative of the other legs of the toy is molded in a hollow construction and is formed with a foot portion 48 to which an upper portion 49 is integrally joined. A flat inner wall 50 is formed on the foot portion 48 and upper portion 49 for location adjacent to the body 12, and formed in the lower portion of the wall 50 is an opening 52. Communicating with the opening 52 and extending through the hollow interior of the foot portion 48 of the leg 38 is a tube 54 having an opening 56 extending therethrough. A recess 58 (FIG. 1) is formed on the opposite side of the foot portion 48, the opening 56 of the tube 54 communicating with the recess 58. Formed in the flat wall 50 in the upper portion 49 of the leg 38 is an elongated slot 62, the slot 62 extendig longitudinally of the upper portion 49 and being generally inclined with respect to the verical. In order to provide for sliding or reciprocable movement of the leg 38 relative to the body 12 as the toy is propelled along a surface on the wheels 27 and 28, a projection 64 (FIG. 4) is provided and is joined to the section 14; while a projection 66 is joined to the section 16 in opposite relation to the projection 64, the projections 64 and 66 being located adjacent the rear of the body 12 and on the enlargements 20 and 24, respectively. The outermost end of the projections 64 and 66 have enlarged heads 68 and 70, respectively, formed thereon, the heads 68 and 70 being oriented such that the longitudinal dimension thereof is perpendicular to the length of the slots as formed in the legs when they are secured to the wheels 27 and 28. Appropriately formed projections having heads 71 and 72 formed thereon are also joined to the forward enlargements 19 and 22, respectively.

As shown in FIG. 1, the leg 38 is secured to its wheel 28 by first positioning the head 68 within the slot 62 as formed in the leg 38 and then rotating the leg 38 so that is positioned with the upper portion 49 in a substantially vertical manner. The head 68 in this position is locked in the slot 62 and rides interiorly thereof in the upper portion 49, the projection 64 extending through the slot 62, thereby providing for reciprocable movement of the leg 38 with respect to the body portion 12. The foot portion 48 of the leg 38 is secured to the wheel 28 by positioning the tube 54 within the recess 42, thereby aligning the openings 56 and 44. A screw 72 is fitted through the opening 58 and tube 54 and threadably engages the threaded opening 44 in the wheel 28. The head of the screw 72 is received in the recess 58 of the foot portion 48 and the screw 72 is tightened to secure the foot portion 48 to the eccentrically located projection 40 of the wheel 28. It is seen that upon rotation of the wheel 28 the foot portion 48 that is secured to the eccentric projection 40 will travel therewith, the upper portion 49 reciprocating relative to the body portion 12 and being confined in the movement thereof by the sliding interaction of the slot 62 on the projection 64. The length of travel of the upper portion 49 of the leg 38 is defined by the length of the slot 62 and the location of the eccentric projection 40 that is secured to the foot portion 48. It is understood that the leg 39 is secured to its wheel 28 and is mounted on the projection 66 as joined to the enlargement 24 in the same manner as described for the leg 38.

In order to achieve a more realistic walking effect of the rear legs 38 and 39 as they are reciprocated to produce an upward and downward movement upon rotation of the wheels 28, eccentric projections 40 as formed on the opposed wheels 28 are displaced 180° with respect to each other. Thus, as one leg 38 moves downwardly, the other leg moves upwardly, as more clearly illustrated in FIG. 1.

The legs 36 and 37 as mounted on the forward portion of the body 12 of the toy animal 10 are secured in place in a manner as described above with respect to the legs 38 and 39, and are similarly constructed having slots formed interiorly thereof for receiving projections on which the heads 71 and 72 are formed, the heads 71, 72 being mounted on the enlargements 19 and 22 located on opposite sides of the body 12. Both of the legs 36 and 37 are also formed with a slot for receiving a projection therein and are provided with the appropriate tubes in the foot portions thereof that are secured to eccentrically located projections on the wheels 27. The projections as formed on the opposed front wheels 27 are positioned 180° apart on opposite sides of the axle 30, so as to provide for opposite movement of the legs 36, 37 as the axle 30 is rotated for movement of the wheels 27 therewith. It is seen that as the toy animal is moved in a propelling motion on the wheels 27 and 28, the legs 36–39 that are secured to the wheels and that are movable in slidable relation on the projections joined to the body 12, are reciprocated to produce or simulate a walking action for the toy.

In order to provide an interesting play effect for the toy animal 10, a tension spring assembly generally indicated at 74 in FIG. 6 is utilized and is mounted on the axle 30, adjacent to the front end of the body 12. The tension spring assembly includes a hub 73 that is fixed to the axle 30 between the wheels 27 and is located interiorly of the body 12. Secured to an end of the hub 73 is a flange 75 that is spaced apart axially from the end of a pulley asssembly 76 that is slidably mounted on the hub 73. A pulley section 78 formed on the pulley assembly 76 receives a draw-string 80 in wound relation thereon, the end of the draw-string extending upwardly through an appropriate opening formed between the sections 14 and 16 and terminating in an outer loop 82. The inner end of the draw-string 80 is secured to the pulley section 78 of the pulley assembly 76. A second pulley section 84 located adjacent to the pulley section 78 has one end of a tension spring 86 attached thereto at 88, the remaining portion of the tension spring being mounted on a pin 90 that is fixed to the inner wall of the section 14. The tension spring 86 is wound in such a manner that it is tensioned upon the winding thereof on the pulley section 84 as the pulley assembly 76 is rotated. Rotation of the pulley assembly 76 is accomplished by pulling outwardly on the draw string 80 through the loop 82. As the pulley assembly 76 rotates, upon outward movement of the drawstring 80, the tension spring 86 is unwound from the pin 90 onto the pulley portion 84. However the hub 73 is prevented from rotating in this direction by a spring clutch 91 that has a finger 93 engaging an end face of the pulley section 76. Release of the draw-string 80 by the user of the device causes the tension spring 86 to rapidly retract and rewind on the pin 90 thereby rapidly rotating the pulley assembly 76. The spring clutch 91 acts to engage the hub 73 with the pulley assembly as the pulley assembly 76 is rotated in the opposite direction by the tension spring 86, thereby rotating the axle 30 secured thereto. Rotation of the axle 30 rotates the wheels 27 mounted thereon for propelling the toy along a surface. As the toy is propelled along the surface by the action of tension spring assembly 74, the legs 36 and 37 are reciprocably moved with respect to the body portion 12 to effect a walking action of the toy.

An ornamental and intersecting effect for the toy is also achieved by locating a hat 92 on the head portion of the toy, the hat including an integrally molded pin 94 that projects through an opening as formed in the head portion 17 between the sections 14 and 16. Ears 96 are secured beneath the hat and extend around the head portion 17 of the toy to simulate the ears of a basset hound. A washer 98 secures the hat 92 in place and also fixes the ears 96 in position on the head 17 of the toy.

In the use of the toy, the user grasps the loop 82 and pulls upwardly to withdraw the draw-string 80 outwardly from the pulley portion 78 of the tension spring assembly 74. The user then releases the draw-string 80, the tension spring 86 rapidly retracting on the pin 90 to rotate the axle 30 and cause the toy to propel along a surface. Rotation of the wheels 27 and 28 produces the reciprocating action of the legs 36–39 to achieve the effect that the toy animal is walking as the toy moves forwardly on the wheels thereof.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy simulating a walking animal, comprising a body, a front axle mounted on said body and having front wheels secured to the outer ends thereof, a rear axle mounted on said body in spaced relation relative to said front axle and having rear wheels secured to the outer ends thereof, a lever simulating a leg of said animal secured to each of said wheels in offset eccentric relation with respect to the leg that is secured to the opposite wheel mounted on the same axle, a pulley mounted on said front axle for rotation therewith interiorly of said body, a draw-string wound on said pulley and extending exteriorly of said body for manipulation by the user of said toy, a reduced pin mounted on the interior of said body in parallel relation to said front axle and spaced therefrom, a tension spring having one end secured to said pulley and the other end fixed to said pin, wherein rotation of said pulley by withdrawal of the draw-string from said body winds said spring on said pulley under tension, and release of said draw-string causes said spring to unwind from said pulley onto said pin, thereby rotating said front axle and said pulley for producing rotation of said front wheels, wherein corresponding propelling motion of said body on said wheels is produced that causes said legs secured to said wheels to reciprocate relative thereto for simulating a walking action of said toy.

2. A toy as claimed in claim 1, each of said wheels having an opening formed in offset eccentric relation therein, and a fastener extending through an opening formed in a portion of a lever and being received in a threaded opening of a wheel for securing each lever to a wheel in offset eccentric relation.

3. A toy as claimed in claim 2, the eccentrically located opening in each wheel being radially displaced 180° with respect to the eccentrically located opening in the opposite wheel mounted on the same axle, wherein the levers as secured to the opposed wheels on an axle are reciprocated in opposite directions upon rotation of said wheels.

4. A toy as claimed in claim 1, an elongated slot formed in each of said levers and extending in a longitudinal direction therein, and a projection fixed to said body adjacent to each of said levers and being received in a slot formed in the lever located adjacent thereto, each of said legs being reciprocably movable on a projection in response to rotation of said wheels.

5. A toy as claimed in claim 4, each slot as formed in a lever extending in a direction that is generally offset with respect to the vertical, wherein the levers are caused to reciprocate in a generally angular direction to simulate a walking action for said toy.

6. A toy as claimed in claim 5, each of said projections having an enlarged head formed thereon, each of said levers being substantially hollow for receiving a projection therein, when the pin on which a projection is formed is slidably received in the slot as formed in a lever, said heads preventing accidental withdrawal of the projections from the slots in which they are received.

7. A toy simulating a walking animal, comprising a body, a front axle mounted on said body and having front wheels secured to the outer ends thereof, a rear axle mounted on said body in spaced relation relative to said front axle and having rear wheels secured to the outer ends thereof, a lever simulating a leg of said animal secured to each of at least an opposed pair of said wheels in offset eccentric relation with respect thereto and being movable upon rotation of said wheels in a direction relative thereto, a pulley mounted on one of said axles for rotation therewith interiorly of said body, a draw-string wound on said pulley and extending exteriorly of said body for manipulation by the user of said toy, a reduced pin mounted in the interior of said body in parallel relation to said axles and spaced from the axle on which said pulley is mounted, a tension spring having one end secured to said pulley and the other end fixed to said pin, wherein rotation of said pulley by withdrawal of the draw-string from said body winds said spring on said pulley under tension, and release of said draw-string causes said spring to unwind from said pulley onto said pin, thereby rotating said pulley and the axle on which the pulley is mounted for producing rotation of the wheels on which said pulley is mounted, wherein a corresponding propelling motion of said body on said wheels is produced that causes said legs secured to said wheels to move relative thereto for simulating a walking action of said toy.

8. A toy as claimed in claim 7, the offset position of a leg as secured to a wheel being displaced radially with respect to the leg that is secured to the opposite wheel mounted on the same axle.

* * * * *